United States Patent [19]

Campbell

[11] 3,992,012

[45] Nov. 16, 1976

[54] ELECTRICAL GOLF CLUB SWING MONITOR

[76] Inventor: Ian R. Campbell, 3 Goswell Ave., Islington, Ontario, Canada, M9A IG2

[22] Filed: Oct. 20, 1975

[21] Appl. No.: 623,945

[52] U.S. Cl. ..... 273/186 R; 273/181 E

[51] Int. Cl.[2] ..... A63B 69/36

[58] Field of Search ..... 273/186 R, 195 A, 186 C, 273/183 A, 181 E

[56] References Cited

UNITED STATES PATENTS

| | | | |
|---|---|---|---|
| 1,532,984 | 4/1925 | Borthwick | 273/186 R |
| 2,933,681 | 4/1960 | Crain | 273/186 R X |
| 3,436,076 | 4/1969 | Barthol | 273/186 R X |
| 3,512,417 | 5/1970 | Anello | 273/186 R X |

FOREIGN PATENTS OR APPLICATIONS

| | | | |
|---|---|---|---|
| 930,715 | 7/1963 | United Kingdom | 273/186 R |

*Primary Examiner*—George J. Marlo
*Attorney, Agent, or Firm*—Fetherstonhaugh & Co.

[57] ABSTRACT

A device for analysing the swing of a golf club having a base, said base having a ball support area, side spin detectors above said base with their free ends adjacent said ball support area for contact by a club head as it passes over said ball support area of said base in a swing with more than a predetermined amount of deviation wherein said side spin detectors comprise side spin resilient whiskers flexible to the passage of a club head thereacross; an electric circuit associated with each of said side spin resilient whiskers operable on flexing of its respective resilient whisker from a standby to an active condition; and an electric alarm for each of said side spin resilient whiskers responsive to the operation of its respective circuit to an active condition to indicate operation to the active condition. A timing device is provided to automatically return the circuit to a standby condition. Additional indicators are located above and below the side spin indicators to tell the golfer whether the club swing is high or low.

6 Claims, 9 Drawing Figures

ELECTRICAL GOLF CLUB SWING MONITOR

This invention relates to a device for indicating the path of travel of the head of a golf club as it strikes a golf ball.

Practically, every golf ball hit has vertical spin about a horizontal axis and side spin about a vertical axis. The only exception is the perfectly hit golf ball that has only vertical spin about a horizontal axis. In every other case, the resultant spin is the combined effect of vertical spin and horizontal spin and is caused by the interaction of the club face alignment with the ball and club path.

Vertical and side spins are each functions of the direction of club head travel and the direction in which the club head faces at the time of impact. Vertical spin depends upon the angle from the vertical the club face makes with the ball at impact and is a function of the club face angle and the direction of the swing. Side spin depends upon the direction the club face faces in a horizontal direction in relation to the direction of club head travel. If the two are the same, there is no side spin but this, in practice, rarely happens. Practically every ball has side spin. Side spin, properly controlled, is the manner in which many golfers achieve success. Side spin, uncontrolled, can spoil a golfer's game. It becomes important, therefore, to analyze the golf swing with a view to controlling side spin.

Variation of vertical spin with a given club is achieved by variation of the angle of travel of the club in the vertical direction at impact. For example, to achieve increased back spin with the higher number irons, one hits in a direction through the ball towards a point in front of the ball to take a divot in front of the ball. Thus, one should not hit the ground behind the ball. With the lower number irons, one prefers to sweep through the ball without taking a divot. Ideally, the club should pass close to but not touch the ground. Thus, the height of the club to the ground is also important in the analysis of a golf swing.

It is an object of this invention to provide a device for recording the direction of travel of the club head when it deviates from a predetermined path in a manner that does not materially affect the golf swing.

Devices of this general nature have been proposed but they tend to be of a nature that unduly interferes with the golf swing and/or do not give a satisfactory analysis of the travel of the club head.

A device for analysing the swing of a golf club according to this invention comprises a base, the base having a ball support area, deviation detectors above said base with their free ends adjacent said ball support area for contact by a golf club head as it passes over said ball support area of said base in a swing which would impart side spin as a result of more than a predetermined amount of deviation, wheren said side spin detectors comprise side spin resilient whiskers flexible to the passage of a club head thereacross, an electric circuit associated with each of said side spin resilient whiskers operable on flexing of its respective resilient whisker from a standby to an active condition and an electric alarm for each of said side spin resilient whiskers responsive to the operation of its respective circuit to an active condition to indicate operation to the active condition.

The invention will be clearly understood after reference to the following detailed specification read in conjunction with the drawings.

Figure 1:
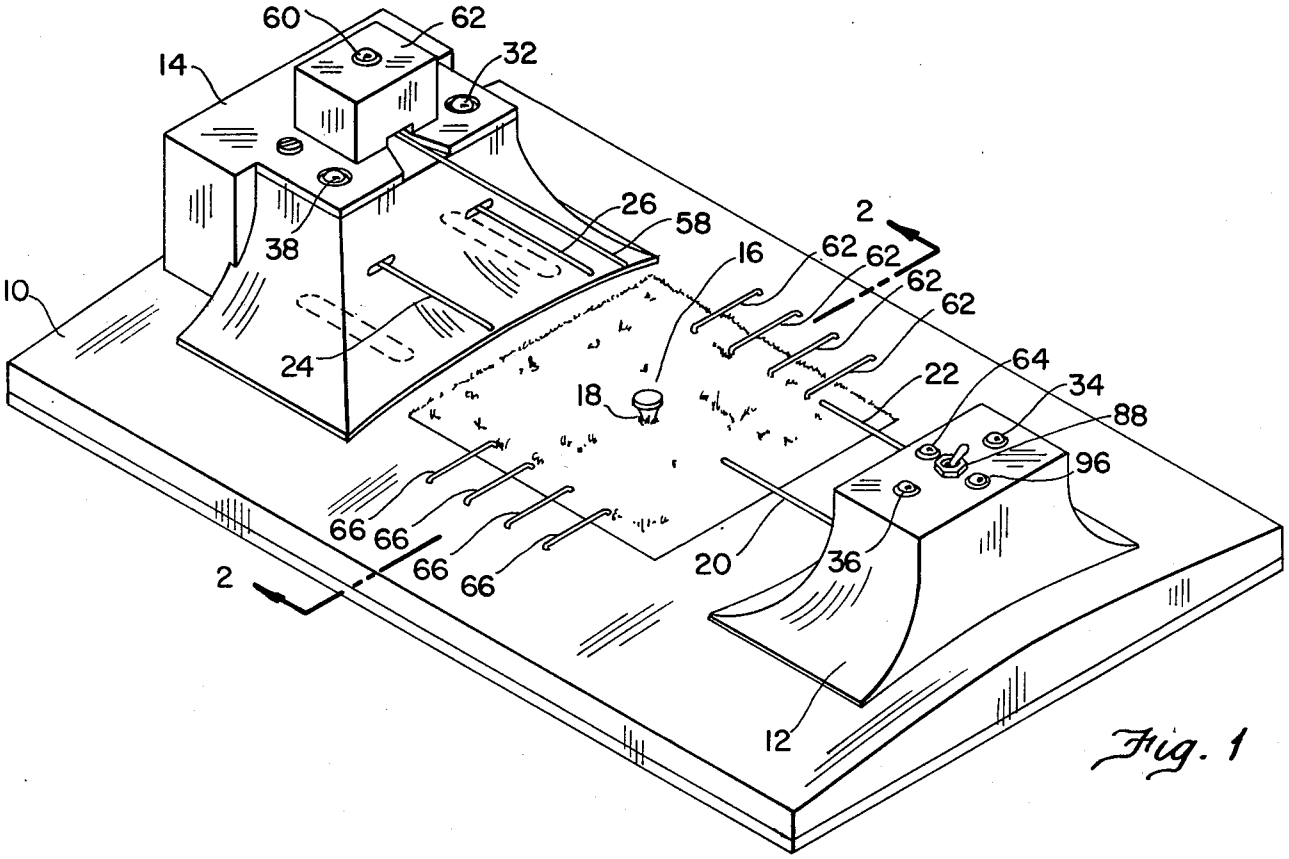
FIG. 1 is a perspective illustration of a device for analysing a golf swing according to the present invention.
Figure 2:
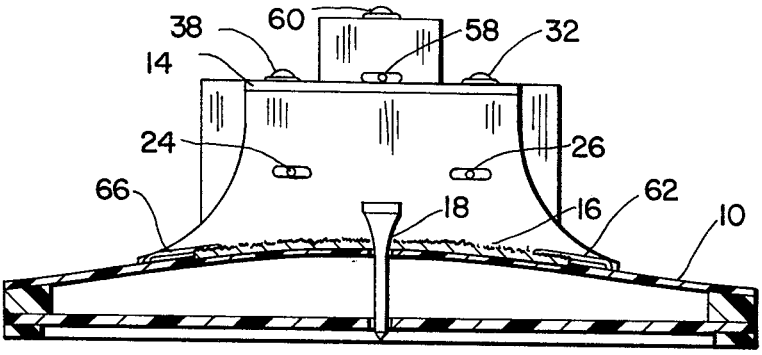
FIG. 2 is a sectional view along the line 2—2 of FIG. 1.

Referring to the drawings and the embodiment of the invention therein shown, the device thereshown comprises a base 10 made of a plastics material and having two posts 12 and 14 extending therefrom. The base, generally indicated by the numeral 10, has a ball support area, generally indicated by the numeral 16, the surrounding area of which is covered with a resilient artificial turf material. A hole 18 extends through the base at the ball support area so that, in use, a person can mount a golf tee for a golf ball should one desire to use the device with a tee. It is, however, not necessary that the device be used with a tee.

As indicated, in use, one places a golf ball over the hole 18 on the ball support area 16 or on a tee in the hole 18 and swings at the golf ball. The purpose of the device is to delineate the path of the swing and this is done in a horizontal direction by means of four resilient side spin whiskers 20, 22, 24 and 26. These whiskers are made from a resilient light gauge wire and are designed to flex out of the way as they are hit by a golf club. While they are resilient so as not to materially interfere with the passage of the club as it passes through the device, they are also stiff enough to actuate an electrical circuit when they are flexed which, in turn, operates a visual electric alarm. Each whisker has its own circuit and operates its own alarm in a manner that indicates that that particular whisker has been hit by the golf club.

Figure 8:
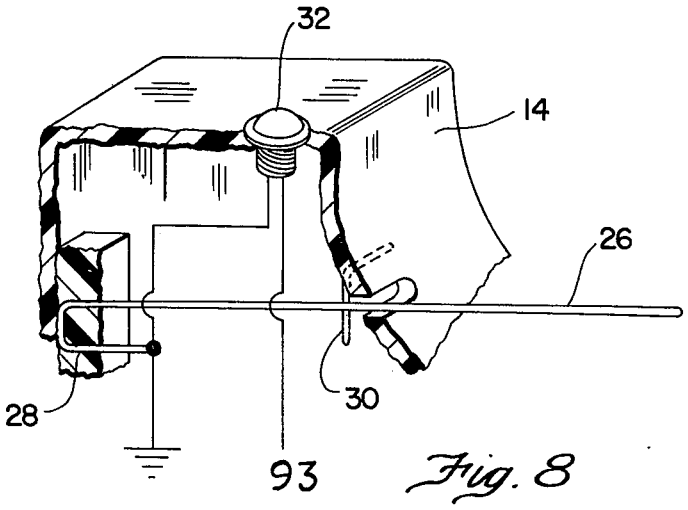
FIG. 8 is an illustration showing the electrical mounting of a whisker detector.

FIG. 8 illustrates the mounting of typical whisker 26 and its operation. Whisker 26 is a piece of resilient wire that is secured at one end in the plastic post member 14 as at 28 and is free to vibrate at its other end in a horizontal direction. In its normal position, it is out of contact with the circuit contact 30 but when vibrated in a horizontal direction by passage of a golf club therepast, it flexes horizontally to make electrical contact with the circuit contact 30 and complete an electrical circuit, as will be described fully later, to operate a circuit that illuminates signal light 32 for a predetermined period of time after the last vibratory contact of the whisker and contact 30. To the golfer, illumination of light 32 indicates that the swing of his golf club passed over the free end of side spin detector whisker 26.

Whisker 26 has an electric alarm light 32. Whiskers 22, 20 and 24 have alarm lights 34, 36 and 38 respectively.

Thus, each of the side spin whiskers has its own electric alarm light that responds with a condition of illumination when it is flexed from its normal position by contact with the head of the golf club.

Figure 5:
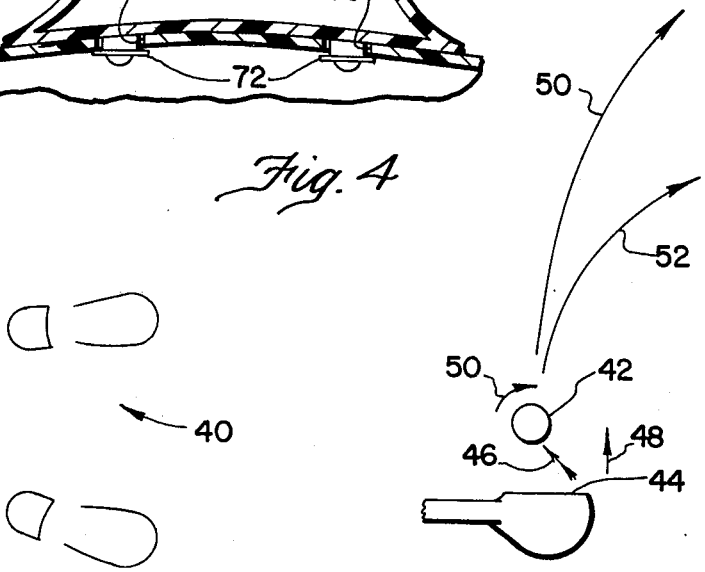
FIG. 5 is an illustration illustrating the relationship of direction of travel of a club head and club face direction in the creation of side spin.
Figure 6:
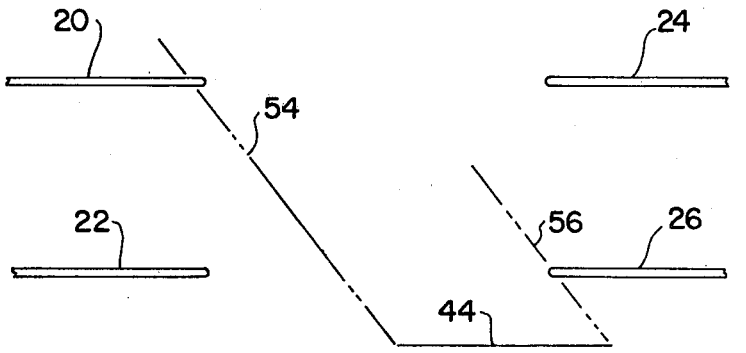
FIG. 6 is a plan view illustrating the side spin whiskers and outling the direction of travel of a club head likely to result in a slice.
Figure 7:
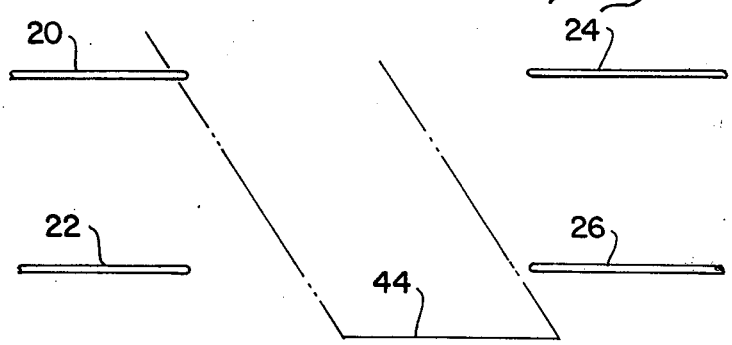
FIG. 7 is a similar view to FIG. 6 but indicating a direction of club head travel likely to result in a fade.

Reference to the use of the side spin detecting whiskers will now be made with FIGS. 5, 6 and 7. In FIG. 5, numeral 40 generally refers to the feet of a golfer swinging his club to hit the ball 42. As he does so, the club face indicated by the numeral 44 travels in the direction of the arrow 46. The numeral 48 represents the direction the club face faces. It will be noted that the direction in which the club face faces 48 is to the right in a clockwise direction of the direction of travel 46 of the club head. It is the relationship of the direction of travel 46 of the club head to the direction 48 that the club face faces that causes side spin.

When the direction the club face faces 48 is to the right of the direction of travel 46 of the club head, the ball will spin in a clockwise direction 50 and the amount of spin will depend upon the difference between the directions 46 and 48. If this difference is relatively small, the spin will be relatively small and the ball will veer to the right with what is termed a fade. The trajectory of a fade is indicated by numeral 50. If the difference between direction 46 and 48 is greater, the side spin will be greater and the ball will veer more severely to the right and result in what is commonly called a slice. Numeral 52 represents the horizontal trajectory of a ball that is sliced.

The direction of travel of the club face 46 that caused the fade or slice is from out to in in relation to the golfer. FIG. 6 is a schematic illustration in plan view of side spin whiskers 20, 22, 24 and 26. Numeral 44 schematically illustrates the club face and the lines 54 and 56 define its path in a horizontal plane past the side spin detector whiskers 20, 22, 24 and 26. In the case that results in a slice, it will be noted that the side spin detector whiskers 26 and 20 are contacted by the club head as it passes through the device. This will result in illumination of lights 32 and 36 and will tell the golfer that his swing was passing from out to in at an angle sufficient to operate both of these alarm signal lights. FIG. 7 illustrates the passage of the golf club head 44 through the device in a manner that actuates only the side spin detector 20. In this case, the direction of travel of the club head is more direct and the club face is not as much to the right of the direction of travel at the time of impact. Such a stroke would result in a fade and would be known to the golfer by illumination of signal light 36 only.

If the golf club travels from in to out in a direction such that the club face direction is to the left of the direction of travel, it will be apparent that the side spin on the ball created by such a direction of travel of the club face will be counterclockwise instead of clockwise and will result in what is known as a hook if the spin is severe and what is known as a draw if the side spin is less severe or slight. In the case of a hook, side spin detectors 22 and 24 would be actuated to illuminate their respective signal lamps to advise the golfer of the path of his club head. In the case of a draw, only whisker 24 and its respective electric alarm light would be illuminated.

If the golfer swings straight and the golf club head travels in the same direction that the golf club face faces, then the club head will pass through the ball area without hitting any of the whiskers 20, 22, 24 and 26. Thus, the device will tell the golfer where his club head passed as he hits the ball from the ball area 16 on the base of the device.

It will be appreciated that differences in direction of travel of the club head and direction in which the club face faces can also be caused by the golfer rotating the club head within his hand. For example, in FIG. 5, the golfer could vary, by rotation of the club in his hand, the direction in which the golf club faced as he swung in the direction 46. The device cannot, of course, detect the angle at which the player holds his golf club. It can only detect the path of the golf club. However, knowing the path that produced an observed horizontal trajectory, the player can adjust his swing path and/or the angle at which he holds the club for correction of the defect observed in the flight of the ball.

In addition, the device will also tell the golfer whether or not his swing is high or low. The side spin detectors are located to be actuated by the club head as it is swung to hit a ball from the tee area of the base. In some cases, however, the ball is struck by the club head when the club head passage of the club head is too high for best results. In such an event, the height detector 58 is actuated and flexed in a horizontal direction to complete an electric circuit and to illuminate its electric alarm signal 60. This height detector 58 is secured in post member 62 which is slidable up and down with respect to post 14 to suit the use of the device when a tee is placed in hole 18 and to suit golfers of varying skill and golfing swing. Any mechanical arrangement for sliding adjustment can be made.

It is also desirable to know the direction of travel of the club head in a vertical direction at the time of impact with the ball. For example, as noted in the preamble to this specification, it is desirable in the case of a short iron stroke to strike the ball and then have the club head proceed to dig into the turf in front of the ball. It is common in attempting this kind of a stroke to strike the turf behind the ball. This device is adapted to detect the striking of the area adjacent the ball behind the ball.

In this latter connection, electricity conducting detector wires 62 spaced apart about an inch and a quarter are mounted close to the base just behind the ball support area. These wires are close to the base and, preferably, not more than one-eight of an inch above the base.

If the golfer swings at a ball and strikes the base behind the area of the ball, the bottom of his golf club passes over two adjacent wires 62 and thereby completes an electric circuit through the golf club which illuminates a signal light 64 to indicate to the golfer that the head of his club struck the base behind the area of the ball rather than in front of the area of the ball. It will be appreciated that the base 10 on which the wires are mounted is an electricity insulator.

A set of wires 66, similar to the wires 62, are provided for use of a golfer of the opposite hand as will be referred to later.

Numeral 96 is a test indicating light for testing the device to indicate that the current is operative.

Figure 3:
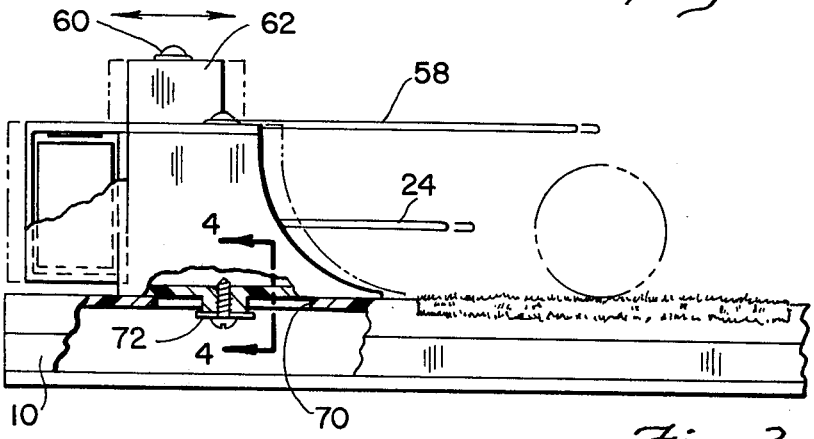
FIG. 3 is a partial sectional view of the device illustrating adjustment of one of the posts.
Figure 4:
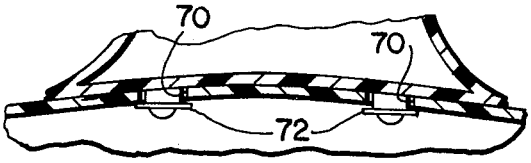
FIG. 4 is a view along the line 4—4 of FIG. 3.

The post 14 is slidable towards and away from the post 12 so that the spacing of the free ends of the whisker detectors can be varied to suit golfers of varying skill and golfing swing. FIGS. 3 and 4 illustrate the manner of adjustment of the post over the base. It will be noted that the base 10 is provided with slots 70 through which bosses on the underside of the post 14 extend. A washer 72 bolted to the bosses extends over the marginal portions of the slots to provide the sliding adjustment. Both posts can be made slidable away or towards the other.

The device can be adapted for use by a right-hand or a left-handed golfer and, in this connection, it will be noted that height detectors 66 are provided in the case where the swing through the device is in the opposite direction for the purpose of detecting the striking of the base behind the ball area.

Figure 9:
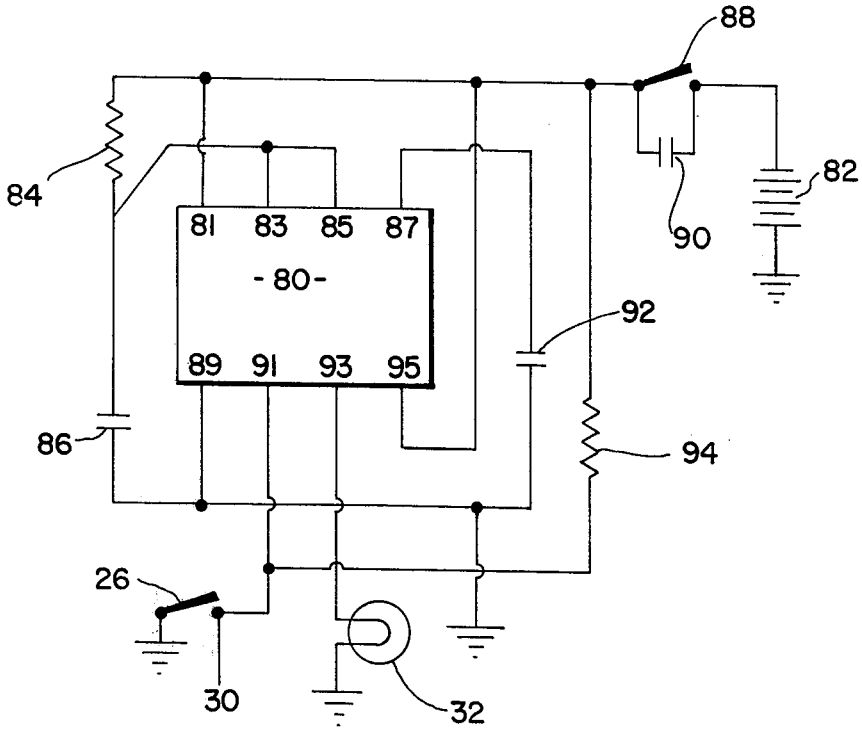
FIG. 9 is a circuit diagram of the alarm system.

The electrical circuit for actuating the electric signal light 32 is capable of almost infinite variation and a person skilled in the art would have no difficulty in devising a suitable circuit capable of lighting a signal light that is responsive to the vibration of the detector whisker 20. In the embodiment illustrated, however, there is shown a suitable device for a whisker detector that employs an integrated circuit generally indicated by the numeral 80. Power to operate the circuit is obtained from a standard 9 volt battery source 82. The contact 30 has been indicated on FIGS. 8 and 9 and is operated by a whisker 26. The integrated circuit has eight terminals 81, 83, 85, 87, 89, 91, 93 and 95 which are connected, as indicated. In the circuit, resistor 84 and condenser 86 are designed to control the amount of time that the integrated circuit conducts. Switch 88, on closure, renders the system operative and condensers 90 and 92 and resistor 94 are inserted into the circuit to control the sensitivity of the circuit as a whole.

When switch 88 is closed, the circuit goes into a standby position, and a light 96 is illuminated for a time interval to indicate the system is powered. The integrated circuit 80 is designed to accept about one-third of the voltage applied by the voltage source 82 and it does not conduct power therethrough to the light 32 in the standby position. When the whisker 26 contacts contact 30 by a head of a golf club hitting detector whisker 26, the integrated circuit accepts a higher voltage and commences to conduct power to the light 32 to illuminate it. At the same time, it charges condenser 86. As the circuit conducts power to the light 32, the charge on condenser 86 drops and when it reaches a predetermined level, integrated circuit 80 ceases to conduct and reverts to its standby position. The value of condenser 86 and resistor 84 determine the time period of conduction of power through the circuit to the light 32 upon actuation of the whisker. Switch 30, of course, is closed only momentarily and the system remains in the standby system until it is again closed. There is a circuit similar to the one described for each of the detector whisker devices.

The alarm system for the wire detectors 62 and 66 is similar except that in the latter case, the integrated circuit is caused to go from the standby to the operative Embodiments of the invention other than the one illustrated will be apparent to those skilled in the art and it is not intended that the scope of the invention should be limited by the specific embodiment illustrated.

I claim:

1. A device for recording the deviation of travel of a golf club head from a desired path, the device having a base and said base having a ball support area, and the device having deviation detectors above said base with their free ends adjacent said ball support area for contact by a club head as it passes over said ball support area of said base in a swing with more than a predetermined amount of deviation, wherein said detectors comprise:

laterally extending resilient whiskers flexible to the passage of a club head thereacross, the whiskers being supported at their fixed ends with respect to the base and having their free ends at the edge of said path, there being at least four of said whiskers, two on each side of said path extending generally toward the path;

an electric circuit associated with each of said resilient whiskers and each circuit including a contact engageable by its respective resilient whisker on flexing, and the circuit being operative upon such engagement to go from a standby to an active condition;

an electric indicator for each of said circuits and operative while said circuit is in an active condition to indicate flexing of the whisker associated therewith; and timing means in each electric circuit for maintaining it in active condition for a predetermined time after engagement of said contact by said whisker, and then automatically returning the circuit to standby condition.

2. A device as claimed in claim 1, and having first height detector means responsive to contact by said club head and mounted on said base with their upper extremities not more than ⅛ of an inch above said base, said first height detectors being behind said ball support area.

3. A device as claimed in claim 2, in which said first height detector means comprises electricity conducting wires spaced apart transversely of the direction of swing and disposed to be electrically connected by the passage of the metallic base of a golf club head thereover, an electric circuit connected to said first height detector wires operable on electrical connection of said wires from a standby to an active condition, and an electric indicator for said first height detector means responsive to operation of its electric circuit to the active condition to indicate operation to the active condition.

4. A device as claimed in claim 1, and having second height detector means, said second height detector active condition to indicate operation to the active condition.

6. A device as claimed in claim 1, and having first height detector means on said base which comprise electricity conducting wires spaced apart transversely of the direction of swing and disposed to be electrically connected by the passage of the metallic base of the golf club head thereover, an electric circuit connected to said first height detector wires operable on electrical connection of said wires from a standby to an active condition, and an electric indicator for said first height detector means responsive to operation of its electric circuit to the active condition to indicate operation to the active condition.

* * * * *